United States Patent [19]

Ilmarinen

[11] Patent Number: 4,917,768

[45] **Date of Patent: * Apr. 17, 1990**

[54] PRESS WITH EXTENDED NIP

[75] Inventor: Antti I. Ilmarinen, Skoghall, Sweden

[73] Assignee: Valmet Paper Machinery, Inc., Helsinki, Finland

[ * ] Notice: The portion of the term of this patent subsequent to Apr. 17, 2007 has been disclaimed.

[21] Appl. No.: 346,169

[22] Filed: May 2, 1989

[30] Foreign Application Priority Data

May 25, 1988 [SE] Sweden ..... 88019344

[51] Int. Cl.[4] ..... D21F 3/02

[52] U.S. Cl. ..... 162/358; 100/153; 162/205; 162/361

[58] Field of Search ..... 162/205, 358, 361, 305; 100/151-153, 154; 29/113.2, 116.2

[56] References Cited

U.S. PATENT DOCUMENTS

| | | | |
|---|---|---|---|
| Re. 30,268 | 5/1980 | Justus | 162/360.1 |
| 3,853,698 | 12/1974 | Mohr | 162/358 |
| 4,272,317 | 6/1981 | Roerig | 162/272 |
| 4,556,454 | 12/1985 | Dahl et al. | 162/358 |
| 4,568,423 | 2/1986 | Laapotti | 162/358 |
| 4,713,147 | 12/1987 | Saarinen | 100/153 |

FOREIGN PATENT DOCUMENTS 254819 4/1987 European Pat. Off. .

71369 9/1986 Finland .

*Primary Examiner*—Karen M. Hastings

*Attorney, Agent, or Firm*—Bell, Seltzer, Park & Gibson

[57] ABSTRACT

A press with extended nip for paper and board machines includes a support element acting as a counter member; a pressure element disposed opposite the support element and including a press shoe and a carrying element carrying the press shoe and designed to be secured to a stand, the press shoe, together with the support element, forming a pressing zone with extended nip; at least one endless movable fluid-impervious belt, being arranged to pass through the pressing zone in sliding contact with the press shoe; and at least one endless, liquid-absorbing felt, arranged to pass through the pressing zone together with a fiber web to be dewatered. The pressure element includes a plurality of jacks disposed in at least one row across the belt and having piston rods acting on the press shoe to force it against the support element, the press shoe being freely supported by the piston rods without rigid mechanical connection therebetween, and the pressure element being provided with a support bearing disposed downstream of the press shoe to absorb horizontal forces acting on the press shoe during operation, the support bearing including a stationary support element mounted on the carrying element.

6 Claims, 2 Drawing Sheets

PRESS WITH EXTENDED NIP

FIELD AND BACKGROUND OF THE INVENTION

The present invention relates to a press with extended nip for paper and board machines, of the type which comprises a support and a pressure device opposite the support and having a press shoe which together with the support forms a pressing zone with extended nip.

Extended nip presses of substantially the above type are described in a large number of patent specifications, see, for instance U.S. Pat. No. 4 272 317, U.S. Re. 30268, U.S. Pat. No. 4 568 423 and FI 71369. It is also known to design the press shoe itself as a part of a jacklike means, as described in e.g. U.S. Pat. No. 3 853 698, U.S. Pat. No. 4 556 454 and EP 0 254 819.

The pressure means of the known presses are often relatively complicated to manufacture, assemble and dismantle for maintenance or replacement, as well as having functional deficiencies during operation.

SUMMARY OF THE INVENTION

The object of the present invention is to provide a press with an improved pressure means, which functions in a satisfactory manner, is easy to manufacture with a resultant reduction in manufacturing costs, and is simple to install and dismantle for maintenance or replacement.

The present invention relates to a press with extended nip for paper and board machines, comprising a support means acting as a counter member; a pressure means disposed opposite said support means and comprising a press shoe and a carrying element carrying the press shoe and designed to be secured to a stand, said press shoe, together with said support means, forming a pressing zone with extended nip; at least one endless movable fluid-impervious belt, being arranged to pass through said pressing zone in sliding contact with said press shoe; and at least one endless, liquid-absorbing felt, arranged to pass through said pressing zone together with a fiber web to be dewatered, said pressure means further comprising a plurality of jacks disposed in at least one row across the belt and having piston rods acting on the press shoe to force it against said support means, said press shoe being freely supported by the piston rods without rigid mechanical connection therebetween, and said pressure means being provided with a support bearing disposed downstream of the press shoe to absorb horizontal forces acting on the press shoe during operation, said support bearing comprising a stationary support element mounted on said carrying element.

BRIEF DESCRIPTION OF THE DRAWINGS

The invention will be described further in the following with reference to the drawings.

DETAILED DESCRIPTION OF THE DRAWINGS

Figure 1:
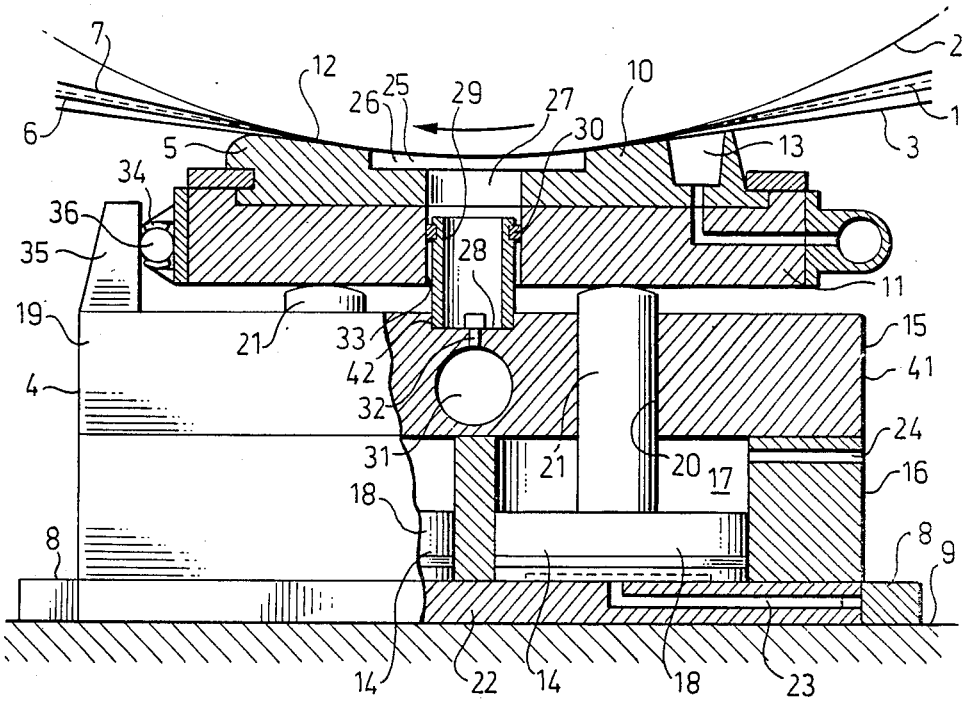
FIG. 1 shows parts of a wet press with extended nip, equipped with a pressing means in accordance with the present invention.

With reference to FIG. 1 it is schematically shown therein parts of a wet press disposed in the wet section of a paper machine or board machine for pressing water out of a formed wet fiber web 1 and compressing said web. The wet press comprises a support means 2 acting as counter member which, in the embodiment shown, consists of a rotating counter roll, and a fluid-impervious belt 3, running in a loop over a plurality of rolls (not shown) and over a predetermined sector of the counter roll 2. A pressure means 4 is disposed opposite the counter roll 2, said pressure means comprising a press shoe 5 which, together with the counter roll 2, forms a pressing zone with extended nip within said predetermined sector of the counter roll 2 where the belt 3 runs over the counter roll 2. Two endless felts 6, 7 are arranged to run in individual loops over a plurality of rolls (not shown) and through the pressing zone. During operation, the continuous wet fiber web 1 passes through the pressing zone together with the belt 3 and felts 6, 7, which receive liquid pressed out of the fiber web 1 located between the felts 6, 7.

The pressure means 4, located within the loop of the belt 3, comprises a carrying element 41 which forms a frame and being provided with suitable attachment means 8 for securing the pressure means 4 to a stand 9 of the wet press.

The press shoe 5 suitably consists of an upper sliding part 10 and a lower frame part 11, the sliding part 10 being provided with a sliding surface 12 along which the belt 3 travels in sliding contact. The press shoe 5 disposed opposite the counter roll 2 extends transversely across the belt 3, parallel to the axis of rotation of the counter roll 2. At the upstream portion, close to its edge, the press shoe 5 is provided with a channel system 13 for the supply of lubricating fluid to the sliding surface 12 so that a friction-reducing film is formed and maintained between the belt 3 and press shoe 5, while at the same time a hydrodynamic pressure is obtained. At the downstream end of the press shoe 5, and more specifically in its lower frame part 11, there is a channel system (not shown) for collecting and recirculating most of the lubricating fluid passing over the sliding surface 12 of the press shoe 5, the downstream edge of the press shoe 5 suitably being rounded so that the lubricating fluid can run off more easily.

The pressure means 4 comprises a plurality of jacks 14 disposed in said carrying element 41. In this embodiment shown the carrying element 41 consists of an oblong, rectangular jack unit 15 extending transversely across the belt 3 parallel to the press shoe 5. In the preferred embodiment shown the jacks 14 are disposed in two rows with a plurality of jacks and the same number of jacks in each row. The jack unit 15 includes a block 16 which is provided with cylindrical cavities 17 for the pistons 18 of the jacks 14 and a plate-like top element 19 closing the cavities 17 at the top and provided with apertures 20 for the piston rods 21 of the jacks. The block 16 is provided with a bottom element 22 closing the cavities 17 at the bottom. Alternatively, said bottom element and block may be made in one piece, the cavities 17 in this case do not pass right through. On both sides of the pistons 18 the cavities 17 are connected via channel systems 23, 24 to a pressure-medium source. The channel systems may suitably be so divided that two or more groups or jacks with one or more jacks in each group can be placed under different pressures so that the fiber web is compressed to varying extents in transverse direction. The ends of the piston rods 21 freely abut the press shoe 5, i.e. there is no rigid mechanical connection therebetween.

Further, the pressure means is provided with a plurality of hydrostatic pressure pockets 25 disposed in a row, each of which including an upper, relatively shallow, rectangular pressure chamber 26 immersed in the sliding surface 12 of the press shoe 5, and a vertical connecting chamber 27 in direct communication with the pressure chamber 26 and having sufficiently large cross section area for the same pressure to prevail throughout the pressure pocket 25. The connecting chamber 27 extends from the pressure chamber 26 through the entire press shoe 5 and continues a suitable distance down into the carrying element 41, or more specifically the top plate 19, so that the bottom 28 of the pressure pocket 25 is located in the top plate 19.

The transition for each pressure pocket 25 between the top plate 19 (carrying element 41) and press shoe 5 is formed by a sleeve 29 extending through opposite apertures 33, 42, down towards the bottom 28 of the pressure pocket 25 and a distance into the press shoe 5. In the embodiment shown the sleeves 29 are rigidly attached to the top plate 19 and are provided at the top with resilient seals 30 sealing against the aperture wall in the press shoe 5. A lower seal may alternatively be disposed to seal against the aperture wall in the top plate 19. The vertical connecting chambers 27 are aligned to each other so that the sleeves 29 will be in a straight line, thus ensuring that none of the sleeves 29 becomes deformed if the press shoe 5 is slightly inclined.

In the top plate 19, below the pressure pockets 25 and spaced a short predetermined distance from their bottom surface 28, a horizontal channel 31 extends which supplies the pressure pockets 25 with pressure fluid from a source, through individual narrow throttle holes 32 with capillary action. The throttle holes 32 have sufficiently small through flow area to ensure that a temporary pressure change in a certain pressure pocket 25 will not affect the pressure in the other pressure pockets 25 due to pressure fluid being quickly pressed into or out of the pressure pocket 25 concerned until equilibrium is achieved again in the system. In this way a stabilized pressure distribution is achieved in the pockets 25 and across the belt 3.

The diameter of each sleeve 29 is slightly less than that of the aperture 33 in the press shoe 5 so that a small clearance is formed therebetween, said clearance thus being sealed by the seal 30 which is in sliding contact with the wall of the aperture. Since the piston rods are not secured to the press shoe 5, and the sleeves 29 are shaped and disposed as described, the press shoe 5 is allowed to move to a limited extent in all directions. The press shoe 5 can thus be considered as being free-flowing within said limitations. It will be understood that a limited inclination of the press shoe 5 also is possible within the limits of the resilience of the seals 30 and the clearance between each sleeve 29 and the opposite aperture walls in the press shoe 5 irrespective of the position of the press shoe 5 in relation to the top plate 19. There is therefore no definite fixed pivotal axis in the pressure means according to the present invention. A greater pressure on the downstream portion of the press shoe 5 can be applied with the aid of the lefthand row of jacks 14, seen in FIG. 1, than on the upstream portion of the press shoe 5 with the aid of the righthand row of jacks 14, thus resulting in an inclination of the press shoe 5. Such an inclination is desirable in order to achieve increasing pressure forces on the fiber web 1 in its direction of travel.

Figure 2:
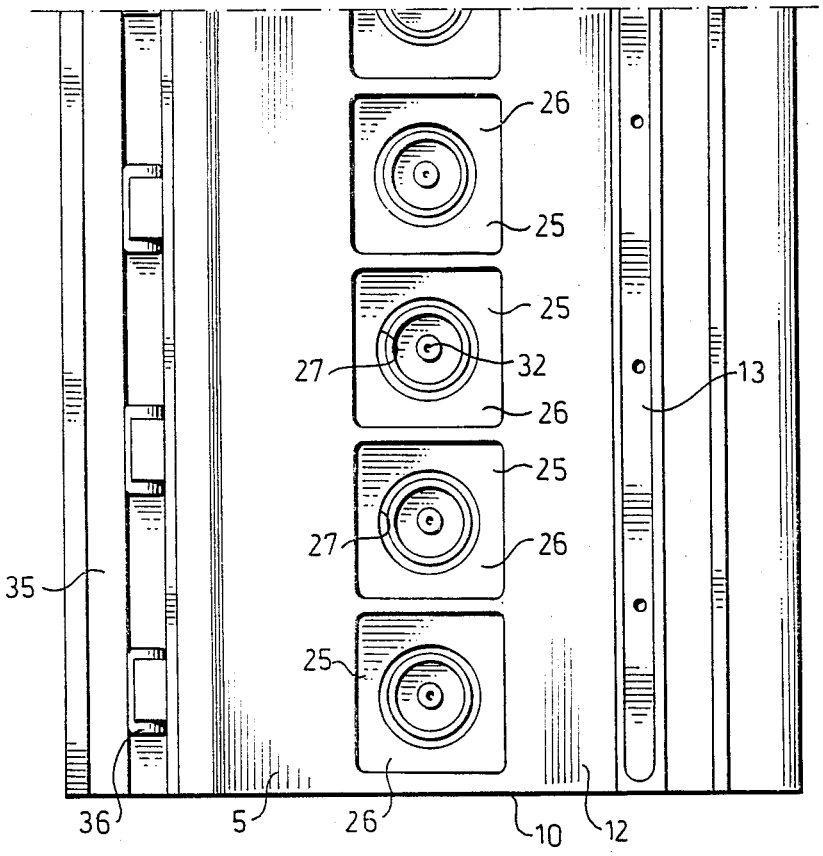
FIG. 2 shows parts of the pressure means according to FIG. 1 from above.

However, the sleeves 29, along which the press shoe 5 is slidable up and down, cannot absorb the considerable horizontal forces which are transmitted to the press shoe 5 from the belt 3 during operation. For this purpose the pressure means 4 according to the present invention comprises a support bearing 34 disposed downstream of the press shoe 5. In the embodiment shown in FIGS. 1 and 2, said support bearing 34 comprises a stationary support element 35 secured to the top plate 19, and rolling bodies 36 rotatably journalled on the downstream side of the press shoe 5 and being in contact with a support surface of the stationary support element 35 and an opposing support surface of the press shoe 5. In the embodiment shown in FIGS. 1 and 2 the rolling bodies comprise a plurality of rollers distributed along the side of the press shoe 5. The rolling bodies may alternatively consist of spheres.

Figure 3:
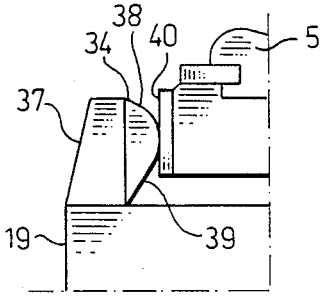
FIG. 3 shows a support bearing according to an alternative embodiment to that in the pressure means according to FIGS. 1 and 2.
Figure 4:
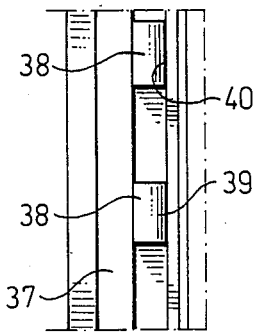
FIG. 4 shows parts of the support bearing according to FIG. 3 from above.

In FIGS. 3 and 4 it is shown an alternative embodiment of a support bearing according to the invention, comprising a support element 37 rigidly attached to the top plate 19 and provided or formed with a plurality of projections 38 facing the press shoe 5. The projections have a convex support surface 39 which is in contact with an opposing support and sliding surface 40 on the downstream side of the press shoe 5.

Instead of a rotating counter roll a second press shoe may be used, having a second endless pressure belt rotating around it. The sliding surface 12 of the press shoe 5 shown and the sliding surface of the press shoe of the second support means are in this case adjusted to fit each other. Both the sliding surfaces are generally made flat, but one of them might even be convex and the other correspondingly concave.

If desired it is of course also possible in a wet press according to the invention to use the jack units only at the ends of the press shoes, i.e. at the edges of the pressure belt, and between these end units to use, for instance, jacks with an upstream jack, which is elongate and disposed transverse to the direction of the machine, and a corresponding downstream jack.

That which is claimed is:

1. An extended nip press for paper and board machines, comprising a support means acting as a counter member; pressure means disposed opposite said support means and comprising a press shoe and a carrying element carrying the press shoe and designed to be secured to a stand, said press shoe, together with said support means, forming an extended nip pressing zone; at least one endless movable fluid-impervious belt arranged to pass through said pressing zone in sliding contact with said press shoe; and at least one endless, liquid-absorbing felt, arranged to pass through said pressing zone together with a fiber web to be dewatered; said pressure means further comprising a plurality of jacks disposed in at least one row across the belt and having pistons with piston rods acting on said press shoe to force it against said support means, said press shoe being freely supported by the piston rods without rigid mechanical connection therebetween, and said pressure means being provided with a support bearing disposed downstream of the press shoe and positioned for engaging the press shoe to absorb horizontal forces acting on the press shoe during operation, said support bearing comprising a stationary support element mounted on said carrying element, and rolling bodies rotatably journaled between and in contact with the press shoe and a support surface of said stationary support element.

2. An extended nip press for paper and board machines, comprising a support means acting as a counter member; pressure means disposed opposite said support means and comprising a press shoe and a carrying element carrying the press shoe and designed to be secured to a stand, said press shoe, together with said support means, forming an extended nip pressing zone; at least one endless movable fluid-impervious belt arranged to pass through said pressing zone in sliding contact with said press shoe; and at least one endless, liquid-absorbing felt, arranged to pass through said pressing zone together with a fiber web to be dewatered; said pressure means further comprising a plurality of jacks disposed in at least one row across the belt and having pistons with piston rods acting on said press shoe to force it against said support means, said press shoe being freely supported by the piston rods without rigid mechanical connection therebetween, and said pressure means being provided with a support bearing disposed downstream of the press shoe and positioned for engaging the press shoe to absorb horizontal forces acting on the press shoe during operation, said support bearing comprising a stationary support element mounted on said carrying element, and one or more projections extending from the stationary support element, said projection or projections having convex support surfaces arranged to abut opposing support and sliding surfaces of said press shoe.

3. An extended nip press for paper and board machines, comprising a support means acting as a counter member; pressure means disposed opposite said support means and comprising a press shoe and a carrying element carrying the press shoe and designed to be secured to a stand, said press shoe, together with said support means, forming an extended nip pressing zone; at least one endless movable fluid-impervious belt arranged to pass through said pressing zone in sliding contact with said press shoe; and at least one endless, liquid-absorbing felt, arranged to pass through said pressing zone together with a fiber web to be dewatered; said pressure means further comprising a plurality of jacks disposed in at least one row across the belt and having pistons with piston rods acting on said press shoe to force it against said support means, said press shoe being freely supported by the piston rods without rigid mechanical connection therebetween, and said pressure means being provided with a support bearing disposed downstream of the press shoe and positioned for engaging the press shoe to absorb horizontal forces acting on the press shoe during operation, said support bearing comprising a stationary support element mounted on said carrying element, and a plurality of hydrostatic pressure pockets disposed in at least one row, the bottom of each pressure pocket being located in said carrying element and communicating with a channel via narrow holes in the carrying element for the supply of pressure fluid to the pressure pockets, the transition between the carrying element and the press shoe at each pressure pocket being formed by a sleeve, said sleeves being so disposed in the pressure pockets that the press shoe can be moved in relation to the carrying element.

4. A press as claimed in claim 3 wherein the sleeves are provided externally with resilient seals sealing against the opposite aperture walls of the pressure pockets, and fitted with a small clearance to said aperture walls so that said press shoe in this way and by the resilience of said seals is allowed a limited inclination by the action of a row of jacks.

5. A press as claimed in claim 4 wherein the sleeves are disposed along a straight line.

6. A press as claimed in any of claims 1, 2 or 3 wherein said support means acting as counter member consists of a rotating counter roll.

* * * * *